US008407860B2

(12) United States Patent
Brennenstuhl et al.

(10) Patent No.: US 8,407,860 B2
(45) Date of Patent: Apr. 2, 2013

(54) APPARATUS FOR FASTENING A HANDLE ON A POWER TOOL

(75) Inventors: Jens Brennenstuhl, Albershausen (DE); Heiko Roehm, Stuttgart (DE); Stefan Schlegl, Kuenzing (DE)

(73) Assignee: Robert Bosch GmbH, Stuttgart (DE)

( * ) Notice: Subject to any disclaimer, the term of this patent is extended or adjusted under 35 U.S.C. 154(b) by 98 days.

(21) Appl. No.: 12/833,353

(22) Filed: Jul. 9, 2010

(65) Prior Publication Data

US 2011/0005355 A1 Jan. 13, 2011

(30) Foreign Application Priority Data

Jul. 9, 2009 (DE) ..... 10 2009 027 570

(51) Int. Cl.
*B25G 1/00* (2006.01)
*A45C 13/26* (2006.01)

(52) U.S. Cl. ..... 16/426; 16/422

(58) Field of Classification Search ..... 16/426, 16/408, 429, 436; 294/58; 408/124, 241 R; 173/161, 162.1, 162.2; 81/177.6, 177.7, 81/177.8, 177.9

See application file for complete search history.

(56) References Cited

U.S. PATENT DOCUMENTS

| | | | | |
|---|---|---|---|---|
| 4,213,643 | A * | 7/1980 | Blind et al. | 292/247 |
| 5,480,197 | A * | 1/1996 | Ernst et al. | 292/113 |
| 6,769,338 | B2 * | 8/2004 | Svetlik et al. | 83/471.3 |
| 2004/0163214 | A1 * | 8/2004 | Cheng | 16/426 |
| 2007/0209162 | A1 * | 9/2007 | McRoberts et al. | 16/426 |
| 2009/0178520 | A1 * | 7/2009 | Engelfried et al. | 81/489 |
| 2010/0005629 | A1 * | 1/2010 | Di Nicolantonio | 16/426 |

FOREIGN PATENT DOCUMENTS

DE 102008000158 A1 7/2009

* cited by examiner

*Primary Examiner* — Chuck Y. Mah
(74) *Attorney, Agent, or Firm* — Kenyon & Kenyon LLP

(57) ABSTRACT

The invention relates to an apparatus for positioning and fastening a device, in particular of a handle on a power tool. The apparatus includes a receptacle for the device, which receptacle is adjustable between at least one positioning position and at least one fastening position. The at least two positions of the device are definable by a tension lever. A detent geometry, embodied with the receptacle, cooperates with a receptacle geometry, embodied on or associated with the power tool. Various radial positions of the apparatus relative to the power tool can be set by the detent geometry and the receptacle geometry. According to the invention, it is provided that in addition, an axial securing device associated with the apparatus or the power tool, is provided, which in the positioning position and the fastening position secures the apparatus in its axial position relative to the power tool.

29 Claims, 2 Drawing Sheets

APPARATUS FOR FASTENING A HANDLE ON A POWER TOOL

CROSS-REFERENCE TO RELATED APPLICATION

This application is based on German Patent Application 10 2009 027 570.3 filed Jul. 9, 2009.

BACKGROUND OF THE INVENTION

1. Field of the Invention

The present invention relates to an apparatus, in particular for positioning and fastening a device, in particular a handle on a power tool.

2. Description of the Prior Art

One such apparatus is known from German Patent Application DE 10 2008 000 158 A1, which was not published prior to the filing date of the present application. The known apparatus has a handle, with a clamping ring which is fastened to the handle and on the inside circumference of which longitudinal ribs are formed that cooperate with corresponding complementary geometries on a power tool. The clamping ring is movable on the handle by means of a tension lever between a first position, in which the power tool can be put into operative connection with the clamping ring, and the second position for fixation of the clamping ring on the power tool. By means of the known apparatus, the handle can be fixed in various radial positions relative to the power tool.

A handle of this kind is typically used in power tools, such as an electric power drill or the like, to make it possible to hold the power tool with both hands on different handles. A further embodiment is shown in German Utility Model DE 79 27 713.7 U1, from which a supplementary handle for an impact drill is known that includes a grip and a clamping ring. The grip is fastened to the clamping ring by means of a screw element, and the clamping ring is embodied in open fashion and has two tabs on which a ring screw is provided. The clamping ring can be clamped or unclamped by tightening or loosening the wing screw. However, such an embodiment has many different parts, and the clamping requires an undesirable screwing operation.

From German Patent Disclosure DE 41 32 058 A1, a supplementary handle for a power drill or the like is also known, in which the clamping ring again has two tabs, through which one long screw is passed. This long screw likewise serves the purpose of fixation of a grip, and clamping or release of the clamping ring is attained by rotation on the grip. Although the number of parts is reduced in this embodiment, nevertheless it can in particular happen that in heavy-duty use of the power tool, the grip is unintentionally rotated, causing the clamping ring to come loose from the power tool. This can result in dangerous situations for a user of the handle.

OBJECT AND SUMMARY OF THE INVENTION

Based on the prior art described, it is the object of the invention to embody an apparatus, in particular for positioning and fastening a device, in particular a handle on a power tool, in such a way that secure positioning of the device on the power tool in both the radial and the axial direction is made possible, and at the same time the construction of the apparatus should be designed as simply as possible. This object is attained in an apparatus, in particular for positioning and fastening a device, in particular a handle on a power tool according to the invention.

In order on the one hand to enable radial positioning of the apparatus on the power tool in various positions in both directions, and at the same time, to ensure the axial positioning of the device in both directions, it is provided in a preferred embodiment that the detent geometry is embodied as longitudinal ribs on an inside circumference of the receptacle; and that the axial securing device includes two retaining elements, which are disposed on both sides of the longitudinal ribs.

It is especially advantageous in this respect if the tension lever is coupled with a spring element, and the spring element, as a function of the position of the tension lever, has at least two stable positions, of which one stable position is the fastening position. As a result, two stable positions of the apparatus on the power tool are achieved, for instance the fastening position and the position for adjusting the radial position of the apparatus on the power tool, which can be changed without having to actuate the tension lever.

It is especially advantageous in this respect if in the fastening position, the tension lever rests flush on a contour of the device. As a result, it is made visually apparent that the device is in a stable position and at the same time, the clamping element is prevented for instance from striking other objects and thus causing an unintentional adjustment.

A further advantageous embodiment provides that the tension lever, for putting the retaining elements out of contact with the receptacle, has an unstable position, in which the tension lever must be held manually counter to the spring force of the spring element. This precludes the device from being unintentionally removed from or shifted on the power tool.

To make the position of the tension lever, in which the tension lever has to be put into order to remove the device from the power tool, unambiguously apparent, it is provided in a further advantageous refinement that the position of the tension lever for putting the retaining elements out of contact with the receptacle is determined by a stop on the device.

To make it possible for the apparatus to be used also on power tools that were not originally intended for receiving an apparatus of the invention for positioning and fastening it, it is also possible in an advantageous embodiment for the receptacle geometry to be embodied on a component embodied separately, as a retaining ring which is connected to the power tool.

However, it is especially advantageous if the receptacle geometry is embodied integrally with the power tool. As a result, the apparatus is especially compact, and no additional devices for fastening the receptacle geometry to the power tool are necessary.

In an embodiment of the invention that is especially easy to produce, it is provided that the two retaining elements are embodied as radially encompassing retaining collars; and the retaining collars immediately adjoin longitudinal ribs of the receptacle geometry.

In this respect it is especially advantageous if a continuous transition from the side of the retaining collars to the level of the retaining collars is embodied without longitudinal ribs. As a result, it becomes possible for the apparatus to be connected to the power tool without requiring that the tension lever be additionally opened manually.

BRIEF DESCRIPTION OF THE DRAWINGS

The invention will be better understood and further objects and advantages thereof will become more apparent from the ensuing detailed description of preferred embodiments taken in conjunction with the drawings, in which.

DESCRIPTION OF THE PREFERRED EMBODIMENTS

Figure 1:
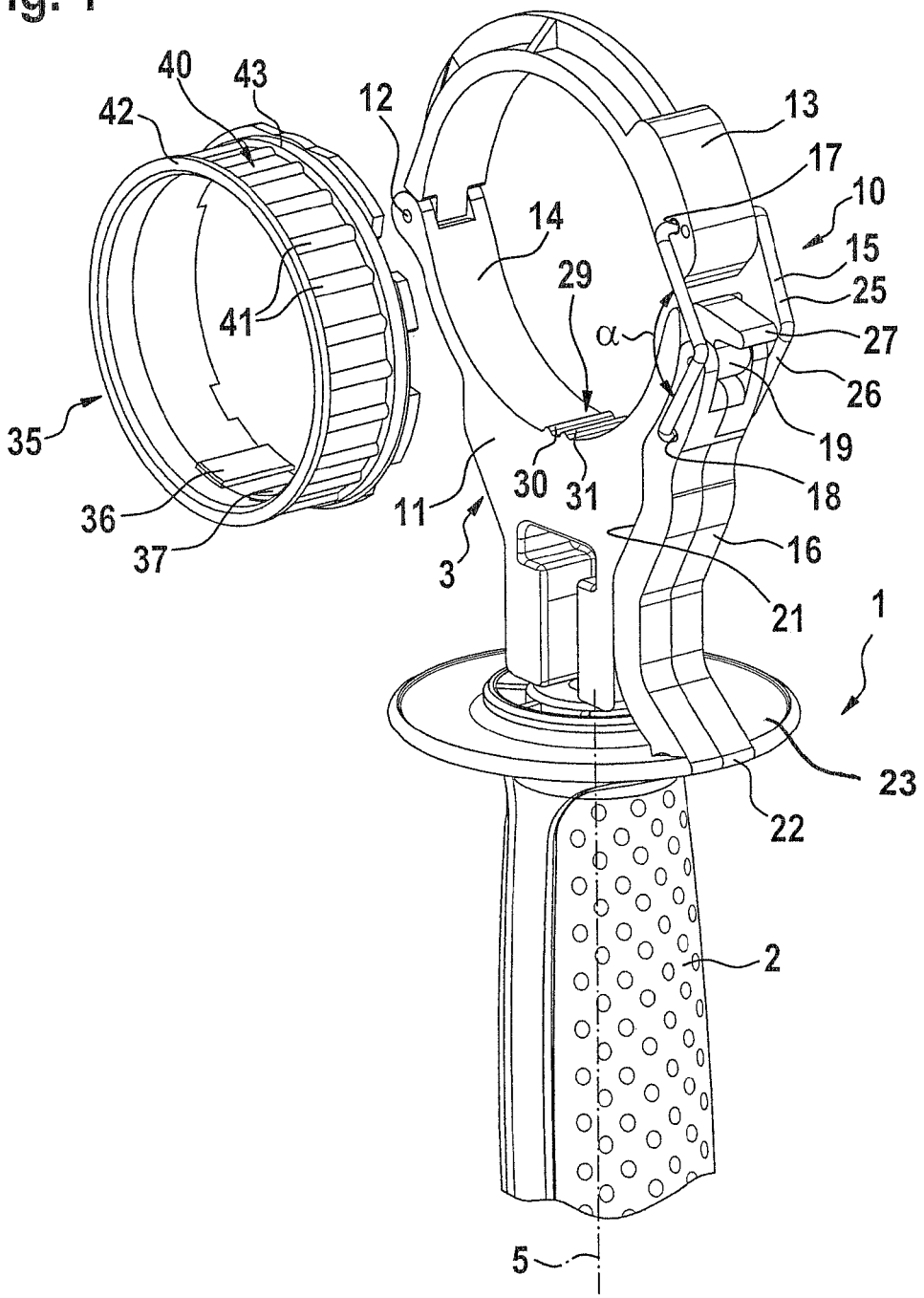
FIG. 1 shows a perspective view on an apparatus of the invention for positioning and fastening a handle on a power tool.

In FIG. 1, a device embodied as a handle 1 is shown. The handle 1 can be connected to a power tool, not shown, and serves as an additional way for a user to hold the power tool, so that when torque occurs, and given the weight of the power tool, the user can brace it better and guide it more precisely.

The handle 1 has a lower region, embodied as a grip 2, which is connected to an upper retaining region 3. Both the grip 2 and the retaining region 3 comprise metal or plastic. The grip 2 can also preferably be positioned in various radial positions relative to the retaining region 3 with respect to a longitudinal axis 5.

The retaining region 3 includes an apparatus 10 for positioning and fastening the handle 1 to the power tool. The retaining region 3 has a lower tool receptacle 11, which via a first joint 12 is connected pivotably to an upper tool receptacle 13. By the lower receptacle 11 and the upper receptacle 13, a receptacle 14 for the power tool is embodied that overall has the shape of a clamping ring. Both the lower tool receptacle 11 and the upper tool receptacle 13 each include an angular range of approximately 180° of the annular receptacle 14.

On the side opposite the first joint 12, the upper tool receptacle 13 is disposed pivotably in various positions by means of a wire clip 15 and a tension lever 16. To that end, the wire clip 15 is received on one end in an opening 17, embodied as a through bore, in the end region of the upper tool receptacle 13, and on the other in an opening 18, also embodied as a through bore, in the tension lever 16. The tension lever 16 is in turn pivotably supported in a second joint 19, whose position is located between the two openings 17 and 18 and which is disposed on the lower tool receptacle 11.

In the first terminal position of the tension lever 16, shown in FIG. 1, in which position the power tool is fixed in the handle 1, the tension lever 16 is in physical contact with an outer contour 21 of the lower tool receptacle 11, and the end 22 of the tension lever 16 ends flush with an intermediate plate 23 on the grip 2. Thus an overall closed, homogeneous design of the handle 1 in the first terminal position is attained.

The self-contained wire clip 15 has two legs 25, 26, one on either side, which are disposed for instance at an angle $\alpha$ of 150°. A stop element 27 is also integrally formed onto the lower tool receptacle 11 and defines the path of motion of the tension lever 16 when the tension lever 16 opens out of its closed position, shown in FIG. 1, into a fully open position.

In the middle region of the lower tool receptacle 11, that is, at the point closest to the grip 2, a detent geometry 29 is embodied, which includes two longitudinal ribs 30, 31 between which a contour 32 in the shape of part of a circle is embodied.

The handle 1 described thus far cooperates with a retaining ring 35, which in the exemplary embodiment is embodied as a separate component and which is connected to the power tool, not shown, by positive engagement. To that end, the retaining ring 35 has two retaining ribs 36, 37, for instance formed onto its inside circumference and extending longitudinally, which make a defined position and locking of the retaining ring 35 in the power tool possible. On the outer circumference of the retaining ring 35, a receptacle geometry 40 is integrally formed on, which includes longitudinal ribs 41 disposed at the same angular spacing from one another, which in cross section each have a sinusoidal shape that corresponds to the contour 32 of the detent geometry 29.

It is also essential that on both sides of the longitudinal ribs 41, the retaining ring 35 has one additional retaining collar 42, 43 each. The two retaining collars 42, 43 are embodied in the exemplary embodiment as retaining collars 42, 43 that radially extend all the way around, but it is also conceivable for each of the retaining collars 42, 43 to include only portions of the circumference of the retaining ring 35. The two retaining collars 42, 43 serve the purpose of axially positioning the retaining ring 35 in the retaining region 3 of the handle 1 and for that purpose are disposed at a spacing to one another that corresponds to the width and thickness of the receptacle 14.

Figure 2:
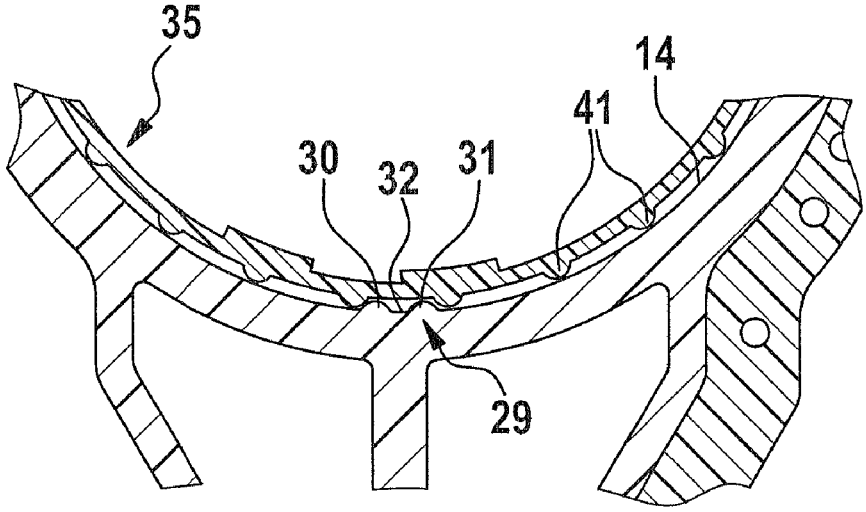
FIG. 2 shows cross sections in the region of a clamping ring, of the kind used in the device of FIG. 1, in a radial position.
Figure 3:
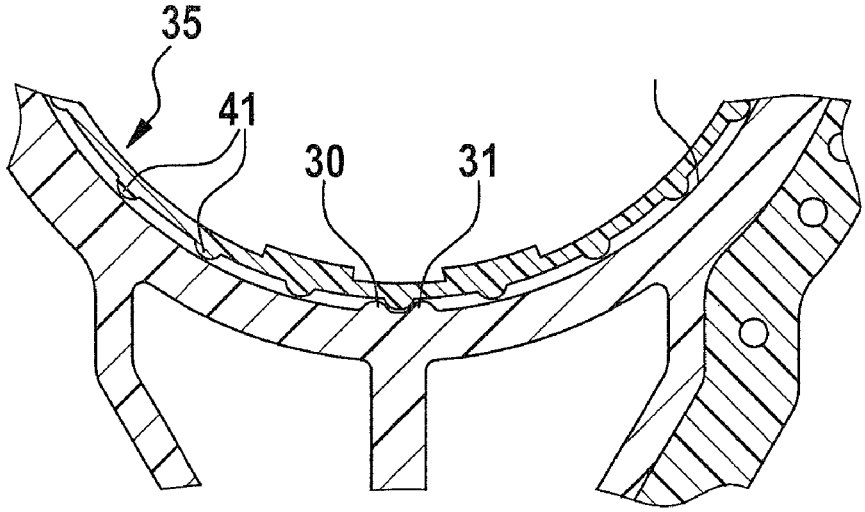
FIG. 3 shows cross sections in the region of a clamping ring, of the kind used in the device of FIG. 1, in a different radial position from that shown in FIG. 2.

As can best be seen from FIGS. 2 and 3, the disposition of the longitudinal ribs 41 in the retaining ring 35 is such that they have a spacing from one another that as shown in FIG. 2 makes it possible to position the retaining ring 35 in a position in the receptacle 14 in which the detent geometry 29 is disposed with its two longitudinal ribs 30, 31 between two longitudinal ribs 41. By comparison, in FIG. 3 the situation is shown in which a single longitudinal rib 41 is located in the region of the contour 32 of the detent geometry 29. Thus with a relatively small number of longitudinal ribs 41, a very finely graduated radial positioning of the retaining ring 35 in the receptacle 14 can be attained.

In FIG. 1, the first terminal position of the tension lever 16 is shown, in which the retaining ring 35 is located in the receptacle 14 and the detent geometry 29 on the receptacle geometry 40 cooperate by positive engagement, so that an unambiguous radial position of the power tool relative to the handle 1 is defined. In the position shown in FIG. 1 of the tension lever 16, the tension lever is in a stable position, because of the geometry of the wire clip 15 and because of the disposition of the joint 19, and this means that the tension lever 16 is self-securing in this position.

Now, if one wishes to position the power tool in a different radial position relative to the handle 1, it is necessary to pivot the tension lever 16, counter to the spring force of the wire clip 15, out of its position shown in FIG. 1 in the joint 19. In the process, the tension lever 16 tilts out of the first stable position into a second stable position, which latter position is attained because of both the geometry of the wire clip 15 and the disposition of the joint 19. In this second position, the retaining ring 35 and the two retaining collars 42, 43 continue to be operatively connected to the lower tool receptacle 11 and the upper tool receptacle 13, respectively, so that the retaining ring 35 and thus the power tool cannot be moved axially relative to the handle 1. By comparison, in the second stable position, the detent geometry 29 and the receptacle geometry 40 are in only partial engagement with one another, so that the power tool and the handle 1 can be radially repositioned relative to one another by overcoming a relatively slight spring force of the wire clip 15.

To disconnect the handle 31 completely from the power tool, it is necessary for the upper tool receptacle 13 to be pivoted so far that the retaining collars 42, 43 of the retaining ring 35 are no longer operatively connected to the handle 1. This requires pivoting the tension lever 16 past its second stable position, until the tension lever enters into physical contact with the stop 27. Because of the embodiment and geometry of the wire clip 15, this must be done while exerting and maintaining a manual force that is counter to the spring force of the wire clip 15. In this way it is precluded that the tension lever 16 will unintentionally be in a position that allows a complete release of the handle 1 from the power tool.

It is further noted that the apparatus 10 can be modified in manifold ways. For instance, it is conceivable in particular not to provide a separate retaining ring 35 for the power tool, but instead to embody the functionality of the retaining ring 35 integrally with the power tool.

The retaining collars 42, 43 can also be embodied, instead of on the retaining ring 35 (or on the power tool) on the lower and upper tool receptacles 11, 13.

In a further embodiment of the invention, it is conceivable to provide the retaining ring 35 or the power tool with a contour or shape that has a continuous transition at least in the direction of one of the retaining collars 42, 43. As a result, for instance for connecting the handle 1 to the retaining ring 35, the handle 1 can slipped over onto the retaining ring 35, without requiring that the tension lever 16 be snapped on manually actively. As a consequence of being thus slipped on axially, the retaining ring 35 automatically enters into operative connection with the receptacle 14.

The foregoing relates to preferred exemplary embodiments of the invention, it being understood that other variants and embodiments thereof are possible within the spirit and scope of the invention, the latter being defined by the appended claims.

The invention claimed is:

1. A power tool comprising:

a device configured for positioning and fastening to said power tool, said device comprising:

a handle;

a mount connected to the handle and adjustable between a positioning setting and a fastening setting, the mount configured to receive the power tool along a mount axis extending longitudinally through the mount;

a clamping device configured for fixing said mount in either of said positioning setting or said fastening setting; and an axial securing element being provided at said power tool to secure said power tool and said device relative to each other in an axial position along the mount axis in each of the positioning setting and the fastening setting of said mount;

wherein said axial securing element comprises two retaining elements; and wherein said mount has a first detent element which is co-operable with a second detent element provided at said power tool, the first and second detent elements configured to set different angular positions of said device with respect to said mount axis.

2. The power tool according to claim 1, wherein the mount has an inside surface, and the first detent element is embodied as at least two longitudinal ribs extending parallel with the mount axis on said inside surface of the mount, and the two retaining elements of the axial securing element are each disposed on and in contact with a respective end of the longitudinal ribs.

3. The power tool according to claim 2, wherein the clamping device includes a tension lever having two stable positions and configured to operate the mount between the positioning setting and the fastening setting, the tension lever being coupled to the mount with a spring element, and the spring element, as a function of a position of the tension lever, has at least two stable positions, wherein one stable position of the spring element corresponds to the fastening setting of the mount.

4. The power tool according to claim 3, wherein, when the mount is in the fastening setting, the tension lever rests flush against an outer contour of the mount.

5. The power tool according to claim 4, wherein the tension lever has a third, an unstable position in which the tension lever must be held manually counter to the spring force of the spring element, and in which third unstable position the tension lever moves the retaining elements out of contact with the mount.

6. The power tool according to claim 5, wherein the third, unstable position of the tension lever, for putting the retaining elements out of contact with the mount, is determined by a stop element on the device.

7. The power tool according to claim 6, wherein the retaining elements are embodied as radially encompassing retaining collars.

8. The power tool according to claim 3, wherein the tension lever has a third, unstable position in which the tension lever must be held manually counter to the spring force of the spring element, and in which third unstable position the tension lever moves the retaining elements out of contact with the longitudinal ribs of the first detent element.

9. The power tool according to claim 2, wherein, both of the first and second detent elements include a plurality of longitudinal ribs, and in one angular position of said device with respect to said mount axis, one longitudinal rib of said second detent element is received with positive engagement between two longitudinal ribs of said first detent element, and in an immediately adjacent angular position of said device with respect to said mount axis, two longitudinal ribs of said first detent element are received with positive engagement between two longitudinal ribs of said second detent element.

10. The power tool according to claim 1, wherein the clamping device includes a tension lever which operates the mount between the positioning setting and the fastening setting, the tension lever being coupled to the mount with a spring element, and the spring element, as a function of a position of the tension lever, has at least two stable positions, wherein one stable position of the spring element corresponds to the fastening setting of the mount.

11. The power tool according to claim 10, wherein, when the mount is in the fastening setting, the tension lever rests flush against an outer contour of the mount.

12. The power tool according to claim 1, wherein the axial securing element is embodied on a retaining ring which is connected to the power tool.

13. The power tool according to claim 12, wherein the retaining elements are embodied as radially encompassing retaining collars.

14. The power tool according to claim 13, wherein the retaining collars immediately adjoin the second detent element embodied as longitudinal ribs extending parallel with the mount axis.

15. The power tool according to claim 12, wherein the retaining elements are embodied as retaining collars which include portions of a circumference of said retaining ring.

16. The power tool according to claim 1, wherein the axial securing element is embodied integrally with the power tool.

17. The power tool according to claim 16, wherein the retaining elements are embodied as radially encompassing retaining collars.

18. The power tool according to claim 17, wherein the retaining collars immediately adjoin the second detent element embodied as longitudinal ribs extending parallel with the mount axis.

19. The power tool according to claim 16, wherein the retaining elements are embodied as retaining collars which include portions of a circumference of an outer surface of said power tool.

20. The power tool according to claim 1, wherein, both of the first and second detent elements include a plurality of longitudinal ribs, and in one angular position of said device with respect to said mount axis, one longitudinal rib of said second detent element is received with positive engagement between two longitudinal ribs of said first detent element, and in an immediately adjacent angular position of said device with respect to said mount axis, two longitudinal ribs of said first detent element are received with positive engagement between two longitudinal ribs of said second detent element.

21. The power tool according to claim 1, wherein said clamping device is embodied as a clamping lever.

22. A power tool comprising:

a device configured for positioning and fastening to said power tool, said device comprising:

a handle;

a mount connected to the handle and adjustable between a positioning setting and a fastening setting, the mount configured to receive the power tool along a mount axis extending longitudinally through the mount;

a clamping device configured for fixing said mount in either of said positioning setting or said fastening setting; and an axial securing element being provided at said power tool to secure said power tool and said device relative to each other in an axial position along the mount axis in each of the positioning setting and the fastening setting of said mount;

wherein said mount has a first detent element which is co-operable with a second detent means element provided at said power tool, the first and second detent elements configured to set different angular positions of said device with respect to said mount axis;

wherein said first detent element comprises at least two longitudinal ribs extending parallel with the mount axis and said second detent element comprises at least two longitudinal ribs extending parallel with the mount axis;

wherein, in one angular position of said device with respect to said mount axis, one longitudinal rib of said second detent element is received with positive engagement between two longitudinal ribs of said first detent element, and in an immediately adjacent angular position of said device with respect to said mount axis, two longitudinal ribs of said first detent element are received with positive engagement between two longitudinal ribs of said second detent element.

23. A power tool comprising:

a device configured for positioning and fastening to said power tool, said device comprising:

a handle:

a mount connected to the handle and adjustable between a positioning setting and a fastening setting, the mount configured to receive the power tool along a mount axis extending longitudinally through the mount;

a clamping device configured for fixing said mount in either of said positioning setting or said fastening setting; and an axial securing element being provided at said power tool to secure said power tool and said device relative to each other in an axial position along the mount axis in each of the positioning setting and the fastening setting of said mount;

wherein said mount has a first detent element which is co-operable with a second detent element provided at said power tool, the first and second detent elements configured to set different angular positions of said device with respect to said mount axis;

wherein said second detent element comprises longitudinal ribs extending parallel with the mount axis;

wherein said axial securing element comprises at least one retaining element, said at least one retaining element having a greater radial extension with respect to the mount axis than said longitudinal ribs.

24. A device configured for positioning and fastening to a power tool, said device comprising:

a handle;

a mount connected to the handle and adjustable between a positioning setting and a fastening setting, the mount configured to receive the power tool along a mount axis extending longitudinally through the mount;

a clamping device configured for fixing said mount in either of said positioning setting or said fastening setting; and an axial securing element being provided on said mount to secure said power tool and said device relative to each other in an axial position along the mount axis in each of the positioning setting and the fastening setting of said mount;

wherein said mount has a second detent element which is co-operable with a first detent element provided at said power tool, the first and second detent elements configured to set different angular positions of said device with respect to said mount axis;

wherein said second detent element comprises at least two longitudinal ribs extending parallel with the mount axis;

wherein said axial securing element comprises at least one retaining element, said at least one retaining element having a greater radial extension with respect to the mount axis than said longitudinal ribs.

25. The device according to claim 24, wherein the axial securing element is embodied on a retaining ring which is connected to the mount, the retaining elements are embodied as radially encompassing retaining collars, and the retaining collars immediately adjoin the second detent element embodied as longitudinal ribs extending parallel with the mount axis.

26. The device according to claim 24, wherein the axial securing element is embodied integrally with the mount, the retaining elements are embodied as radially encompassing retaining collars, and the retaining collars immediately adjoin the second detent element embodied as longitudinal ribs extending parallel with the mount axis.

27. The device according to claim 24, wherein the axial securing element is embodied on a retaining ring which is connected to the mount, and the retaining elements are embodied as retaining collars which include portions of a circumference of said retaining ring.

28. The device according to claim 24, wherein the axial securing element is embodied integrally with the mount, and the retaining elements are embodied as retaining collars which include portions of a circumference of an inner surface of said mount.

29. The device according to claim 24, wherein said clamping device is embodied as a clamping lever.

* * * * *